US009650583B2

(12) United States Patent
Garrett et al.

(10) Patent No.: US 9,650,583 B2
(45) Date of Patent: May 16, 2017

(54) ADDITIVE AND FUEL COMPOSITIONS CONTAINING DETERGENT AND FLUIDIZER AND METHOD THEREOF

(75) Inventors: Debra L. Garrett, Cleveland, OH (US); Mitchell M. Jackson, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 976 days.

(21) Appl. No.: 11/576,491

(22) PCT Filed: Oct. 19, 2005

(86) PCT No.: PCT/US2005/037436

§ 371 (c)(1), (2), (4) Date: Apr. 2, 2007

(87) PCT Pub. No.: WO2006/044892

PCT Pub. Date: Apr. 27, 2006

(65) Prior Publication Data

US 2009/0025283 A1 Jan. 29, 2009

(51) Int. Cl.

| | |
|---|---|
| ***C10L 1/238*** | (2006.01) |
| ***C10L 1/14*** | (2006.01) |
| ***C10L 10/06*** | (2006.01) |
| *C10L 1/16* | (2006.01) |
| *C10L 1/183* | (2006.01) |
| *C10L 1/188* | (2006.01) |
| *C10L 1/198* | (2006.01) |
| *C10L 1/2383* | (2006.01) |
| *C10L 1/2387* | (2006.01) |
| *C10L 1/30* | (2006.01) |

(52) U.S. Cl.

CPC ..... *C10L 1/238* (2013.01); *C10L 1/143* (2013.01); *C10L 10/06* (2013.01); *C10L 1/1616* (2013.01); *C10L 1/1832* (2013.01); *C10L 1/1883* (2013.01); *C10L 1/1985* (2013.01); *C10L 1/2383* (2013.01); *C10L 1/2387* (2013.01); *C10L 1/305* (2013.01); *C10L 1/306* (2013.01)

(58) Field of Classification Search

CPC ..... C10L 10/00; C10L 1/143; C10L 1/221; C10L 1/238; C10L 1/1616

USPC ..... 44/415

See application file for complete search history.

(56) References Cited

U.S. PATENT DOCUMENTS

| | | | | |
|---|---|---|---|---|
| 4,568,358 | A * | 2/1986 | Courtney | 44/387 |
| 5,697,988 | A * | 12/1997 | Malfer et al. | 44/415 |

FOREIGN PATENT DOCUMENTS

| | | | |
|---|---|---|---|
| EP | 0440248 | B1 | 8/1995 |
| EP | 1132455 | A1 * | 9/2001 |
| EP | 1132455 | A1 | 9/2001 |
| WO | WO01/66673 | A2 | 9/2001 |
| WO | WO03/070861 | A2 | 8/2003 |
| WO | WO03/078553 | A2 | 9/2003 |
| WO | WO 03078553 | A2 * | 9/2003 |
| WO | WO2006/044892 | A1 | 3/2006 |

* cited by examiner

*Primary Examiner* — Ellen McAvoy
*Assistant Examiner* — Ming Cheung Po
(74) *Attorney, Agent, or Firm* — Iken S. Sans; Teresan W. Gilbert

(57) ABSTRACT

A fuel additive composition comprises (a) a Mannich reaction product and (b) a polyetheramine where the weight ratio on an actives basis of component (a) to component (b) is 1:4-10. A fuel composition and a method for removing intake valve deposits and combustion chamber deposits in a spark-ignited internal combustion engine comprise the fuel additive composition which is very effective in removing the deposits.

14 Claims, No Drawings

ADDITIVE AND FUEL COMPOSITIONS CONTAINING DETERGENT AND FLUIDIZER AND METHOD THEREOF

This application claims the benefit of U.S. Provisional Application No. 60/620,097 filed Oct. 19, 2004.

BACKGROUND OF THE INVENTION

1. Field of the Invention

The present invention involves a fuel additive composition, a fuel composition containing the fuel additive composition, and a method comprising the fuel composition. The compositions and method of the invention are effective in removing deposits in an internal combustion engine.

2. Description of the Related Art

Deposits in the fuel delivery system and combustion chamber of an internal combustion engine can adversely affect combustion performance in terms of emissions and power output which in turn can affect engine response and fuel economy. Consequently, development of more effective fuel additives to prevent and/or reduce deposits is highly desirable.

Graiff in Canadian Patent No. 2,089,833 discloses a gasoline composition comprising a Mannich detergent and a polyether carrier or fluidizer for deposit control and prevention of low temperature intake valve sticking.

Ahmadi et al. in EP Publication No. 1132455A1 and Malfer et al. in EP Publication No. 0647700A1 disclose a fuel composition comprising a Mannich detergent and a polyetheramine fluidizer for deposit control.

Oppenlander et al. in U.S. Pat. No. 5,660,601 disclose a polyetheramine which can function in a gasoline fuel composition as a detergent or also partly as a fluidizer when another detergent is present.

Ritt et al. in U.S. Pat. No. 5,161,336 disclose an apparatus for intake valve deposit removal which requires taking a motor vehicle out of service and partial disassembly of the engine.

The present invention provides an unexpected and effective performance in a fuel composition for an internal combustion engine by preventing and removing deposits from both the intake valves and combustion chambers, especially in an internal combustion engine that has a high service mileage and/or has been run on a low tier fuel having a minimal deposit control performance.

SUMMARY OF THE INVENTION

An object of the present invention is to prevent and remove deposits in the intake portion and combustion portion of the fuel system of an internal combustion engine.

Another object of this invention is to prevent and remove deposits in the intake portion and combustion portion of the fuel system of a spark-ignited internal combustion engine.

A further object of the invention is to prevent and remove both intake valve deposits and combustion chamber deposits in a spark-ignited internal combustion engine.

Additional objects and advantages of the invention will be set forth in part in the description that follows and in part will be obvious from the description or may be learned by the practice of this invention. The objects and advantages of the invention may be realized and attained by means of the instrumentalities pointed out in the appended claims.

To achieve the foregoing objects in accordance with the invention, as described and claimed herein, a fuel additive composition comprises (a) a Mannich reaction product of a hydrocarbyl-substituted phenol wherein the hydrocarbyl substituent has a number average molecular weight of from 500 to 3000; an aldehyde; and an amine; and (b) a polyetheramine represented by the formula $R[OCH_2CH(R^1)]_nA$ wherein R is a hydrocarbyl group; $R^1$ is selected from the group consisting of hydrogen, hydrocarbyl groups of 1 to 16 carbon atoms, and mixtures thereof, n is a number from 2 to about 50; A is selected from the group consisting of $—OCH_2CH_2CH_2NR^2R^2$ and $—NR^3R^3$ wherein each $R^2$ is independently hydrogen or hydrocarbyl; each $R^3$ is independently hydrogen, hydrocarbyl or $—[R^4N(R^5)]_pR^6$ wherein $R^4$ is $C_2$-$C_{10}$ alkylene; $R^5$ and $R^6$ are independently hydrogen or hydrocarbyl; p is a number from 1-7; and the weight ratio on an actives basis of component (a) to component (b) is 1:4-10.

In an embodiment of the invention a fuel composition comprises a hydrocarbon fuel, and the fuel additive composition of the invention as described throughout this application wherein the fuel additive composition is present in the fuel composition on a weight basis at 600 to 10,000 ppm.

In another embodiment of the invention a method for removing intake valve deposits and combustion chamber deposits in a spark-ignited internal combustion engine comprises operating the engine with the fuel composition of the invention as described throughout this application wherein the hydrocarbon fuel of the fuel composition comprises a gasoline.

DETAILED DESCRIPTION OF THE INVENTION

The fuel additive composition of the present invention can comprise (a) a detergent comprising a nitrogen-containing detergent to include for example a member selected from a succinimide, a Mannich reaction product, a hydrocarbyl-substituted amine, and a mixture thereof and (b) a fluidizer comprising a polyether-containing compound to include for example a member selected from a polyether, a polyetheramine, and a mixture thereof wherein the weight ratio on an actives basis of component (a) to component (b) is 1:4-10. A hydrocarbyl group as used throughout this application is defined as a univalent group having 1 or more carbon atoms, that is predominately hydrocarbon in nature, and that can contain heteroatoms such as for example oxygen and/or nitrogen in the main carbon chain or in attachments to the main carbon chain.

In an embodiment of the invention the fuel additive composition can comprise (a) a Mannich reaction product of a hydrocarbyl-substituted phenol wherein the hydrocarbyl substituent has a number average molecular weight of from 500 to 3000, an aldehyde, and an amine, and (b) a polyetheramine represented by the formula $R[OCH_2CH(R^1)]_nA$ wherein R is a hydrocarbyl group; $R^1$ is selected from the group consisting of hydrogen, hydrocarbyl groups of 1 to 16 carbon atoms, and mixtures thereof, n is a number from 2 to about 50; A is selected from the group consisting of $—OCH_2CH_2CH_2NR^2R^2$ and $—NR^3R^3$ wherein each $R^2$ is independently hydrogen or hydrocarbyl; each $R^3$ is independently hydrogen, hydrocarbyl or $—[R^4N(R^5)]_pR^6$ wherein $R^4$ is $C_2$-$C_{10}$ alkylene; $R^5$ and $R^6$ are independently hydrogen or hydrocarbyl; p is a number from 1-7; and the weight ratio on an actives basis of component (a) to component (b) is 1:4-10.

Mannich Reaction Product

The Mannich reaction product of the invention can be derived from a hydrocarbyl-substituted hydroxy-containing aromatic compound to include a hydrocarbyl-substituted phenol. The hydrocarbyl substituent can have a number average molecular weight of 500 to 3000, and in other instances can have a number average molecular weight of 700 to 2300, or 750 to 1500. The hydrocarbyl substituent can be derived from a polyolefin. The polyolefin can be derived from polymerization of an olefin monomer or a mixture of olefin monomers to include for example ethylene, propylene, various butene isomers including isobutylene, or a mixture thereof. The hydrocarbyl-substituted phenol can be obtained by well known methods of preparation to include alkylating phenol with a polyolefin using an alkylation catalyst such as boron trifluoride. In an embodiment of the invention the polyolefin used to alkylate phenol can be a polyisobutylene, and in other instances the polyisobutylene used to alkylate phenol can be a conventional polyisobutylene having a vinylidene isomer content of 30% or less, a high vinylidene polyisobutylene having a vinylidene isomer content of at least 50% or at least 60% or at least 70%, or a mixture thereof. In several embodiments of the invention a polyisobutylene alkylated phenol can be obtained by alkylating phenol with a mixture of a conventional polyisobutylene and a high vinylidene polyisobutylene or by combining a phenol alkylated with conventional polyisobutylene and a phenol alkylated with high vinylidene polyisobutylene. Commercial examples of highly reactive or high vinylidene content polyisobutylenes include Glissopal® marketed by BASF.

The aldehyde of the Mannich reaction product of the invention can be a $C_1$-C6 aldehyde to include for example acetaldehyde or formaldehyde where formaldehyde can be used in one of its reagent forms such as paraformaldehyde or formalin.

The amine of the Mannich reaction product of this invention can be any compound having at least one reactive primary or secondary amino group capable of undergoing a Mannich condensation reaction. The amine can be a monoamine, a polyamine that contains 2 or more amino groups, or a mixture thereof. The monoamine can comprise ammonia, a primary amine such as e.g. ethylamine, a secondary amine such as e.g. dimethylamine, an alkanolamine such as e.g. diethanolamine, or a mixture thereof. In an embodiment of the invention the amine of the Mannich reaction product is a secondary monoamine to include e.g. dimethylamine, diethylamine, a dipropylamine, or a dibutylamine. The polyamine can comprise an alkylenediamine and/or an alkyl-substituted alkylenediamine such as e.g. ethylenediamine and 3-(dimethylamino)propylamine, a polyethylenepolyamine such as e.g. diethylenetriamine, an alkanolamine such as e.g. 2-(2-aminoethylamino)ethanol, or a mixture thereof.

The Mannich reaction product of this invention and its preparation are well known in the art. The Mannich reaction product can be prepared by reacting a hydrocarbyl-substituted phenol, an aldehyde and an amine at elevated temperatures of 100-200° C. as described in U.S. Pat. No. 5,876,468.

Polyetheramine

The polyetheramine of the present invention can be any compound having 2 or more ether groups and at least one amino group which can be a primary or secondary or tertiary amino group. In an embodiment of the invention the polyetheramine can be represented by the formula $R[OCH_2CH(R^1)]_nA$ as described and defined above. R can be a hydrocarbyl group having 1 to 30 carbon atoms, 3 to 24 carbon atoms, or 6 to 20 carbon atoms. R can be derived from an alcohol, an alkylphenol, or a mixture thereof where the mixture can be a mixture of 2 or more alcohols, 2 or more alkylphenols, or 1 or more alcohols and 1 or more alkylphenols. The alcohol can be linear, branched, or a mixture thereof. $R^1$ can be hydrogen, methyl, ethyl, or a mixture thereof. The polyetheramine can be derived from a polyether intermediate which can be formed from the reaction product of an alcohol and/or alkylphenol with an alkylene oxide or with 2 or more different alkylene oxides in a mixture or sequentially where the ratio of alcohol and/or alkylphenol to alkylene oxide can be 1:2-50, and in other instances can be 1:10-38, 1:16-28, or 1:18-26. The number n in the formula for the polyetheramine can correspondingly be 2 to 50, 10 to 38, 16 to 28, or 18 to 26. The alkylene oxide can have 2 to 18 carbon atoms, and in another instance can have 2 to 4 carbon atoms. In several embodiments of the invention the alkylene oxide can be ethylene oxide, propylene oxide, butylene oxide, or a mixture thereof. The polyether intermediate and its preparation are well known in the art. The polyether intermediate can be formed by condensing an alcohol and/or alkylphenol with an alkylene oxide in a base catalyzed reaction as disclosed and described in U.S. Pat. No. 5,094,667.

The polyether intermediate can be converted to a polyetheramine where A is $—NR^3R^3$ by a direct amination reaction of the polyether intermediate and an amine as disclosed and described in European Patent Publication No. 310875 where the amine can be a monoamine or polyamine as described above for the amine of the Mannich reaction product.

The polyether intermediate can be converted to a polyetheramine where A is $—OCH_2CH_2CH_2NR^2R^2$. In an embodiment of the invention the polyether intermediate can be converted to a polyetheramine where A is $—OCH_2CH_2CH_2NH_2$ by reacting the polyether intermediate with acrylonitrile to form a cyanoethylated intermediate which can then be hydrogenated to form the polyetheramine as disclosed and described in U.S. Pat. No. 5,094,667.

The fuel additive composition of the present invention can comprise a Mannich reaction product and a polyetheramine as they are disclosed and described throughout this application. The Mannich reaction product and polyetheramine can be present in the fuel additive composition on an actives basis where the Mannich reaction product to polyetheramine weight ratio is 1:4-10, and in other instances where the weight ratio is 1:4.5-9, 1:5-9.5, 1:5.5-8, 1:5.5-7.5, or 1:6-7.

Hydrocarbon Solvent

The fuel additive composition of the present invention can further comprise (c) a hydrocarbon solvent. The hydrocarbon solvent can be present in the fuel additive composition and can provide for compatibility, homogeneity, and facility in handling and transfer operations of the fuel additive composition. The hydrocarbon solvent can comprise an aliphatic hydrocarbon solvent, an aromatic hydrocarbon solvent, or a mixture thereof. In an embodiment of the invention an organic polar solvent can also be present in the hydrocarbon solvent to include e.g. an alcohol, a ketone, an ether, or a mixture thereof. The hydrocarbon solvent can have a flash point of 40° C. or higher. In several embodiments of the invention the hydrocarbon solvent is an aromatic naphtha having a flash point above 40° C. or above 62° C., a kerosene with a 16% aromatic content having a flash point above 62° C., or a mixture thereof. The hydrocarbon solvent can be present in the fuel additive composition on a weight basis at 40 to 60%, at 30 to 70%, or at 20 to 80%. The combination of the Mannich reaction product and polyetheramine can also be present in the fuel additive composition on a weight basis at 40 to 60%, at 30 to 70%, or at 20 to 80%.

Additional Additives

The fuel additive composition of the invention can comprise (d) at least one additional additive. The additional additives are well known in the art and can comprise a detergent such e.g. a hydrocarbyl-substituted succinimide, a fluidizer such as e.g. a polyether, an anti-knock agent such as e.g. a tetra-alkyl lead compound or MMT (methylcyclopentadienyl manganese tricarbonyl), a lead scavenger such as e.g. a halo-alkane, a dye, an antioxidant such as e.g. a hindered phenol, a corrosion inhibitor such as e.g. an alkylated succinic acid and/or anhydride, a bacteriostatic agent, a gum inhibitor, a metal deactivator, a demulsifier, an anti-valve seat recession additive such as e.g. an alkali metal sulfosuccinate salt, an anti-icing agent, or a mixture thereof. The additive can be present in the fuel additive composition at 20 to 80% by weight and can be present in a corresponding fuel composition at 0.1 to 10,000 ppm (parts per million) by weight.

Fuel Composition

A fuel composition of the present invention can comprise a hydrocarbon fuel and a fuel additive composition as disclosed and described throughout this application comprising the Mannich reaction product and the polyetheramine where the fuel additive composition can be present in the fuel composition on a weight basis at 300 or 600 or 700 or 900 or 1,000 to 10,000 ppm. In several other embodiments of the invention the fuel additive composition can be present in the fuel composition on a weight basis at 1,500 to 8,000 ppm, at 1,700 to 6,000 ppm, or at 600 or 700 or 900 or 1,000 or 1,700 to 3,000 or 4,000 ppm. In several additional embodiments of the invention the weight ratio on an actives basis of Mannich reaction product to polyetheramine in the fuel additive composition can be 1:5.5-8 or 1:5.5-7.5 or 1:6-7 and the fuel additive composition can be present in the fuel composition on a weight basis at 600 or 700 or 900 or 1,000 or 1,700 to 3,000 or 4,000 ppm. The fuel additive composition as described above can further comprise (c) a hydrocarbon solvent, (d) at least one additional additive, or a mixture thereof where component (c), component (d), or the mixture thereof can also be present in the fuel composition. The hydrocarbon fuel is normally a liquid fuel and can comprise a natural hydrocarbon, a synthetic hydrocarbon such as e.g. a liquid hydrocarbon from a synthesis gas process like the Fischer-Tropsch process, or a mixture thereof. In an embodiment of the invention a nonhydrocarbon fuel can also be present in the hydrocarbon fuel to include e.g. an alcohol such as ethanol or methanol, an ether, a nitroalkane such as nitromethane, a carboxylate ester, or a mixture thereof. The natural hydrocarbon can comprise a petroleum distillate fuel which can comprise a gasoline as defined by ASTM Specification D439 or a diesel fuel or fuel oil as defined by ASTM Specification D396. In an embodiment of the invention the hydrocarbon fuel comprises a natural hydrocarbon which comprises a gasoline where the gasoline is a mixture of hydrocarbons having an ASTM distillation range from about 60° C. at the 10% distillation point to about 205° C. at the 90% distillation point, and in another embodiment the hydrocarbon fuel comprises a gasoline and a nonhydrocarbon fuel such as an alcohol. The gasoline of the present invention can be lead-containing or can be lead-free.

In one embodiment the fuel is a gasoline fuel termed ultra low sulfur gasoline (ULSG), which has a maximum 50 parts per million (ppm) sulfur content and a 95% distillation temperature of less than 205° C. as determined by the test method specified in ASTM D86 distillation. A typical range for the sulfur content of the fuel is 0 to 50 ppm or 1 to 30 ppm or 2 to 15 ppm.

Method for Removing Deposits

A method of the present invention for preventing and removing intake valve deposits, combustion chamber deposits, and fuel injector deposits in an internal combustion engine comprises operating the engine with the fuel composition as described above. In an embodiment of the invention a method for removing intake valve deposits and combustion chamber deposits in a spark-ignited internal combustion engine comprises operating the engine with a fuel composition comprising a gasoline and a fuel additive composition as disclosed and described throughout this application. In embodiments of the invention the method for removing both intake valve and combustion chamber deposits in a spark-ignited internal combustion engine comprises an engine that has accumulated a high service mileage of 10,000 or more miles, of 25,000 or more miles, or of 40,000 or more miles. In an embodiment of the invention the method for removing both intake valve and combustion chamber deposits in a spark-ignited internal combustion engine comprises an engine that has been previously operated on a fuel composition having minimal deposit control performance such as e.g. a fuel that just meets the US EPA (Environmental Protection Agency) lowest additive concentration (LAC) requirement. In a further embodiment of the invention the method for removing both intake valve and combustion chamber deposits in a spark-ignited internal combustion engine comprises an engine that has accumulated a high service mileage as described above, an engine that has been previously operated on a fuel composition having minimal deposit control performance as described above, or a combination thereof.

The following examples are set forth only for illustrative purposes.

Engine Deposit Removal Evaluations

The test results set forth in Tables 2 through 7 below demonstrate the superior effectiveness of the fuel additive composition and fuel composition of the present invention in controlling both intake valve deposits (IVD) and combustion chamber deposits (CCD) in a gasoline engine by preventing and removing the deposits.

Fuels containing the additives in Table 1 were fleet tested in high mileage consumer cars driven 44,000-95,000 miles. Measurements were taken after first running the vehicles for 1200 miles on a treated unleaded regular gasoline containing a typical treatment level of 100 ppm detergent. This was done to equilibrate the various driving histories of the vehicles. A one tank cleanup (350 miles) was run using the treated unleaded regular gasoline that also contained the additives of Example 1 or 2 as indicated in Table 1. The results of this fleet test are shown in Tables 2 through 4. Positive numbers listed under each performance feature are the average percent improvement, followed by the number of cars improved out of the total number of vehicles tested.

TABLE 1

Additive Compositions For One Tank Fleet Test Results In Unleaded Gasoline For Tables 2-4

| Example # | Mannich Reaction Product (a) | ppm (actives) | Polyetheramine (b) | ppm (actives) | Actives Wt Ratio (a):(b) |
|---|---|---|---|---|---|
| 1 (Comparative) | None | 0 | A[1] | 3200 | — |
| 2 | B[2] | 390 | C[3] | 2400 | 1:6.15 |

[1]Polyetheramine A was prepared by cyanoethylating and hydrogenating a polyether from the reaction of a $C_{13}$ alcohol with 20 units of butylene oxide.

[2]Mannich reaction product B was prepared from an alkylphenol and dimethylamine where the alkyl group was derived from a high vinylidene content polyisobutylene of 1000 mol. wt.

[3]Polyetheramine C was prepared by cyanoethylating and hydrogenating a polyether from the reaction of a $C_{12-15}$ alcohol and 24 units of propylene oxide.

TABLE 2

Fuel Economy Data For One Tank Fleet Test Results In Unleaded Gasoline

| Example # | Average % Fuel Economy Improvement | Number of Vehicles Improved of Number Tested |
|---|---|---|
| 1 (Comparative) | 2.5% | 2 of 4 |
| 2 | 2.3%* | 7 of 7 |

*This data is statistically significant at a $95^{th}$ percentile confidence interval.

TABLE 3

| IVD Cleanup Data For One Tank Fleet Test Results In Unleaded Gasoline | | |
|---|---|---|
| Example # | Average % Intake Valve Deposit Removal | Number of Vehicles Improved of Number Tested |
| 1 (Comparative) | 51%* | 5 of 5 |
| 2 | 72%* | 7 of 7 |

*This data is statistically significant at a 95th percentile confidence interval.

TABLE 4

| CCD Cleanup Data For One Tank Fleet Test Results In Unleaded Gasoline | | |
|---|---|---|
| Example # | Average % Combustion Chamber Deposit Removal | Number of Vehicles Improved of Number Tested |
| 1 (Comparative) | 39%* | 5 of 5 |

TABLE 4-continued

| CCD Cleanup Data For One Tank Fleet Test Results In Unleaded Gasoline | | |
|---|---|---|
| Example # | Average % Combustion Chamber Deposit Removal | Number of Vehicles Improved of Number Tested |
| 2 | 46%* | 7 of 7 |

*This data is statistically significant at a 95th percentile confidence interval.

Fuels containing the additives in Table 5 were tested in a 1.8 L Toyota Corolla, model year 1999. Measurements were taken after first running the vehicle for 1,500-5,000 miles on treated unleaded regular gasoline containing 100 ppm detergent. This was done to establish combustion chamber deposits or equilibrate existing deposits in the vehicle. A one tank cleanup (350 miles) was run using the treated unleaded regular gasoline that also contained the additives of Example 1, 2, 3 or 4 as indicated in Table 5.

TABLE 5

| One Tank Combustion Chamber Deposit Cleanup Results In Unleaded Gasoline For 1.8 L Toyota Corolla | | | | | | |
|---|---|---|---|---|---|---|
| Example No. | Mannich (a) | ppm (actives) | PEA (b) | ppm (actives) | Actives Wt Ratio (a):(b) | Average % CCD Removal |
| 1 (Comparative) | None | 0 | A[1] | 3200 | — | 29 |
| 2 | B[2] | 390 | C[3] | 2400 | 1:6.15 | 63 |
| 3 | B[2] | 330 | C[3] | 2030 | 1:6.15 | 39 |
| 4 | B[2] | 145 | C[3] | 880 | 1:6.07 | 18 |

[1]PEA (polyetheramine) A was the same as PEA A of Table 1.
[2]Mannich B was the same as Mannich B of Table 1.
[3]PEA C was the same as PEA C of Table 1.

Fuels containing the additives in Table 6 were tested in a 2.2 L Toyota Camry, model years 1998 and 1999. Measurements were taken after first running the vehicle for 1,200-5,000 miles on treated unleaded regular gasoline containing 100 ppm detergent. This was done to establish combustion chamber deposits or equilibrate existing deposits in the vehicle. A one tank cleanup (350 miles) was run using the treated unleaded regular gasoline that also contained additives of Example 1, 2, 3, 4, 5, or 6 as indicated in Table 6.

TABLE 6

| One Tank Combustion Chamber Deposit Cleanup Results In Unleaded Gasoline For 2.2 L Toyota Camry | | | | | | |
|---|---|---|---|---|---|---|
| Example No. | Mannich (a) | ppm (actives) | PEA (b) | ppm (actives) | Actives Wt Ratio (a):(b) | Average % CCD Removal |
| 1 (Comparative) | None | 0 | A[1] | 3200 | — | 20 |
| 2 | B[2] | 390 | C[3] | 2400 | 1:6.15 | 55 |
| 3 | B[2] | 145 | C[3] | 880 | 1:6.07 | 28 |
| 4 | B[2] | 505 | C[3] | 2030 | 1:4.02 | 7 |
| 5 | B[2] | 410 | C[3] | 1620 | 1:3.95 | 3 |
| 6 | B[2] | 875 | C[3] | 975 | 1:1.11 | 2 |

[1]PEA (polyetheramine) A was the same as PEA A of Table 1.
[2]Mannich B was the same as Mannich B of Table 1.
[3]PEA C was the same as PEA C of Table 1.

Fuels containing the additives in Table 7 were tested in a 2.3 L Ford dynamometer engine Intake Valve Cleanup Test. Measurements were taken after first running the engine for 100 hours in a standard ASTM D6201 test on treated gasoline containing 100 ppm detergent. Using the deposit-containing valves from these tests, a 5 hour cleanup was run using the treated gasoline that also contained additives of Example 1 or 2 as indicated in Table 7.

TABLE 7

One Tank Intake Valve Deposit Cleanup Results In Unleaded Gasoline For 2.3 L Ford Dynamometer

| Example No. | Mannich (a) | Ppm (actives) | PEA (b) | ppm (actives) | Actives Wt Ratio (a):(b) | Average % IVD Removal |
|---|---|---|---|---|---|---|
| 1 (Comparative) | None | 0 | A[1] | 3200 | — | 20 |
| 2 | B[2] | 520 | C[3] | 2400 | 1:4.62 | 39 |

[1]PEA (polyetheramine) A was the same as PEA A of Table 1.
[2]Mannich B was the same as Mannich B of Table 1.
[3]PEA C was the same as PEA C of Table 1.

Each of the documents referred to in this Detailed Description of the Invention section is incorporated herein by reference. All numerical quantities in this application used to describe or claim the present invention are understood to be modified by the word "about" except for the examples or where explicitly indicated otherwise. All chemical treatments or contents throughout this application regarding the present invention are understood to be as actives unless indicated otherwise even though solvents or diluents may be present.

The data in the tables illustrates that the present invention reduces intake valve deposits and combustion chamber deposits. An additional benefit of this reduction in deposits is the increase in power regeneration and the reduction of $CO_2$ emissions.

What is claimed is:

1. A fuel additive composition, comprising:

(a) a Mannich reaction product of a hydrocarbyl-substituted phenol wherein the hydrocarbyl substituent has a number average molecular weight of from 500 to 3000, an aldehyde, and an amine; wherein the amine comprises a secondary monoamine; and (b) a polyetheramine represented by the formula $R[OCH_2CH(R^1)]_nA$ wherein R is a hydrocarbyl group; $R^1$ is selected from the group consisting of hydrogen, hydrocarbyl groups of 1 to 16 carbon atoms, and mixtures thereof; n is a number from 2 to about 50; A is —$OCH_2CH_2CH_2NR^2R^2$ wherein each $R^2$ is independently hydrogen or hydrocarbyl; and the weight ratio on an actives basis of component (a) to component (b) is from 1:5.5 to 1:9.5.

2. The additive composition of claim 1 wherein the hydrocarbyl substituent of component (a) is derived from a polyisobutylene having a vinylidene isomer content of at least 70%.

3. The polyetheramine of the additive composition of claim 1 wherein R has 1 to 30 carbon atoms and is derived from an alcohol, an alkylphenol, or a mixture thereof; $R^1$ is hydrogen, methyl, ethyl, or a mixture thereof; and n is a number from 10 to 38.

4. The additive composition of claim 3 wherein the hydrocarbyl substituent of component (a) is derived from a polyisobutylene having a vinylidene isomer content of at least 70%.

5. The additive composition of claim 1, further comprising:

(c) a hydrocarbon solvent.

6. The additive composition of claim 1, further comprising:

(d) at least one additional additive.

7. A fuel composition, comprising:

a hydrocarbon fuel; and the additive composition of claim 1 wherein the additive composition is present in the fuel composition on a weight basis at 600 to 10,000 ppm.

8. The fuel composition of claim 7 wherein the hydrocarbon fuel comprises a gasoline.

9. The fuel composition of claim 8 wherein the additive composition is present in the fuel composition on a weight basis at 600 to 4,000 ppm.

10. A method for removing intake valve deposits and combustion chamber deposits in a spark-ignited internal combustion engine, comprising:

operating the engine with the fuel composition of claim 8.

11. The method of claim 10 wherein the engine has accumulated a service mileage of 10,000 or more miles, the engine has been previously operated on a fuel composition having minimal deposit control performance, or a combination thereof.

12. The composition of claim 1 wherein R has 1 to 30 carbon atoms and is derived from an alcohol, an alkylphenol, or a mixture thereof; R1 is hydrogen, methyl, ethyl, or a mixture thereof; and n is a number from 10 to 38; and wherein A is —OCH2CH2CH2NH2.

13. The composition of claim 1 wherein A is —OCH2CH2CH2NH2; and wherein the composition further comprises (c) a hydrocarbon solvent.

14. The composition of claim 1 wherein R has 1 to 30 carbon atoms and is derived from an alcohol, an alkylphenol, or a mixture thereof; R1 is hydrogen, methyl, ethyl, or a mixture thereof; and n is a number from 10 to 38; and wherein A is —OCH2CH2CH2NH2; wherein the hydrocarbyl substituent of (a) is derived from a polyisobutylene having a vinylidene isomer content of at least 70%; and wherein the amine of component (a) is a secondary monoamine, and A is —OCH2CH2CH2NH2 for the polyetheramine; and wherein the composition further comprises (c) a hydrocarbon solvent.

* * * * *